United States Patent [19]

Hefni et al.

[11] 4,060,778

[45] Nov. 29, 1977

[54] MICROWAVE HARMONIC ABSORPTION FILTER

[75] Inventors: Ibrahim El Hefni, North Andover; Kenneth A. Green, Andover, both of Mass.; Donald C. Cloutier, Newton, N.H.

[73] Assignee: Microwave Research Corporation, North Andover, Mass.

[21] Appl. No.: 704,211

[22] Filed: July 12, 1976

[51] Int. Cl.[2] ..... H01P 1/20; H01P 1/22; H01P 1/16; H01P 1/26

[52] U.S. Cl. ..... 333/73 W; 333/34; 333/82 B; 333/98 R

[58] Field of Search ..... 333/73 W, 82 R, 82 A, 333/82 B, 98 R, 97, 22 R, 22 F, 81 B, 34

[56] References Cited

U.S. PATENT DOCUMENTS

| | | | |
|---|---|---|---|
| 2,877,434 | 3/1959 | Farr et al. | 333/81 B X |
| 3,187,277 | 6/1965 | Wantuch | 333/73 W |
| 3,353,123 | 11/1967 | Met | 333/73 W |

OTHER PUBLICATIONS

Paine et al. "Harmonic Absorbing Filters in Waveguides" in Electrical Communication vol. 39, No. 2, 1964; pp. 260–264.

*Primary Examiner*—Alfred E. Smith
*Assistant Examiner*—Marvin Nussbaum
*Attorney, Agent, or Firm*—David E. Brook

[57] ABSTRACT

A microwave harmonic absorption filter is disclosed which has an extended single mode pass-band ranging over one or more octaves as well as enhanced attenuation in the stop-band. This filter has a primary, rectangular waveguide having one or more ridges on the inner surfaces of its elongated wall members. Secondary waveguides are provided on the outer surfaces of these wall members and these secondary waveguides serve to diminish propagation of microwave energy in the stop-band. Apertures extend through the wall members of the primary, ridged, rectangular waveguide so that microwave energy within the range of frequencies of the stop-band can be transmitted from the primary waveguide into the secondary waveguides.

5 Claims, 9 Drawing Figures

MICROWAVE HARMONIC ABSORPTION FILTER

BACKGROUND OF THE INVENTION

1. Field of the Invention

This invention is in the field of microwave energy transmission and particularly relates to microwave harmonic absorption filters.

2. Description of the Prior Art

In many microwave signal processing systems, it is required and/or desirable to transmit microwave energy in one range of frequencies called the pass-band while attenuating energy in a second range of frequencies called the stop-band. This can be accomplished by microwave filters which fall into many categories according to the relationship between their pass-band and stop-band. As and example, a low pass filter has a pass-band situated at a lower range of frequencies than its stop-band, while a high pass filter has its pass-band at higher frequencies than its stop-band.

It is also possible to subdivide low pass filters into two groups: reflective low pass filters and absorptive low pass filters. The former type reflect back most of the incident energy for frequencies within the stop-band, while the latter do not reflect energy, but instead, absorb incident energy within the stop-band range of frequencies in an appropriate lossy medium. Absorptive low pass filters may have the additional property of absorbing incident energy for any propagating mode of the stop-band. Thus, they do not only absorb in the fundamental mode of propagation of energy, but also in the next few higher order modes.

One type of harmonic absorption filter which has been used is known as the "leaky-wall" type. In these "leaky-wall" harmonic absorption filters, a main waveguide is coupled to one or more secondary waveguides by means of apertures. The pass-band range of frequencies is transmitted in the main or primary waveguide whereas the stop-band range of frequencies is transmitted from the primary waveguide through apertures into the secondary waveguides wherein they are greatly attenuated. Several such "leaky-type" microwave harmonic absorption filters are described in the patent literature.

One such "leaky-type" harmonic absorption filter is disclosed by Farr et al. in U.S. Pat. No. 2,877,434. The Farr et al. filter comprises a cylindrical conductive wall forming a waveguide for transmitting electromagnetic waves in first and second modes that tend to produce first transversely directed and second longitudinally directed currents with the cylindrical conductive wall. This filter also has a mode absorber comprising an annular chamber of rectangular cross-section disposed contiguously on the outside of the cylindrical wall with at least one longitudinally disposed slot in the wall leading to the annular chamber and an annular sheet of resistive material in the chamber.

Another microwave harmonic absorption filter is disclosed by Wantuch in U.S. Pat. No. 3,187,277. In the Wantuch filter, a main waveguide channel is provided with a series of apertures on all four sides and each aperture is provided with an associated short waveguiding passageway. Subordinate microwave chambers containing lossy material extend parallel to the main waveguide and many of the small waveguiding passageways are coupled to a single one of these subordinate lossy chambers. Dielectric rods may extend through the passageways to more strongly couple harmonics from the main waveguide to the subordinate waveguide chambers where the harmonic energy is dissipated. By extending the rods physically into the main waveguide, or the lossy subordinate chambers, or both, it is stated that much greater attenuation of the harmonic energy is achieved.

The harmonic absorption filters heretofor available, however, have not achieved single mode pass-bands extending to one octave of frequency i.e., a ratio of 2/1. In fact, due to the properties of the rectangular waveguides used in many of the prior art filters, the ratio has typically only been 1.5/1.

SUMMARY OF THE INVENTION

In one embodiment, the invention comprises a microwave harmonic absorption filter having a primary, ridged, rectangular waveguide suitable for transmitting microwave energy within the pass-band range of frequencies. Secondary waveguides are connected to the primary, ridged, rectangular waveguide by apertures which extend through the walls of the primary waveguide. Thus, microwave energy within the stop-band range of frequencies is transmitted from the primary waveguide into the secondary waveguides wherein it is attenuated. The use of ridges within the primary rectangular waveguide provides a single mode band width within the pass-band of multiple octaves. Thus, a fundamental limitation on the heretofor available harmonic absorption filters is overcome.

Locating a ridge on the center of the elongated inner surface of the wall members of the primary rectangular waveguide can interfere, in some cases, with the coupling apertures to the secondary waveguides. It is known, for example, that the coupling apertures cannot be made to intercept the ridges, because this would greatly disturb proper operation of the filter in the pass-band. Therefore, such apertures are restricted to be on the sides of the ridges only. However, in a further refinement of this invention, the primary rectangular waveguide has only one ridge placed therein on the center of one of its elongated wall members. On the wall member having the ridge, the apertures are located on the sides of the ridge which provides good filtering for the $TE_{n,0}$ modes, where $n$ is even. This is because such modes have electric fields wherein the maxima are located off-center. On the other elongated wall member, centered apertures are located which strongly couple to $TE_{n,0}$ modes, when $n$ is odd. This is because the electric field maxima for such modes are located on-center. The result is greater attenuation of unwanted frequencies than would be possible in double ridge filters.

Further refinements of this invention relate to the use of impedance transformer tapers which allow the transition from double-ridge waveguides to single-ridge waveguides. These tapers can include slots of gradually increasing dimensions to reduce reflections.

The resulting microwave harmonic absorption filters of this invention have significantly wider bandwidths in the pass-band, and yet have excellent attenuation in the stop-band. These features have heretofor been unavailable in prior art harmonic absorption filters.

DESCRIPTION OF PREFERRED EMBODIMENTS

Figure 1:
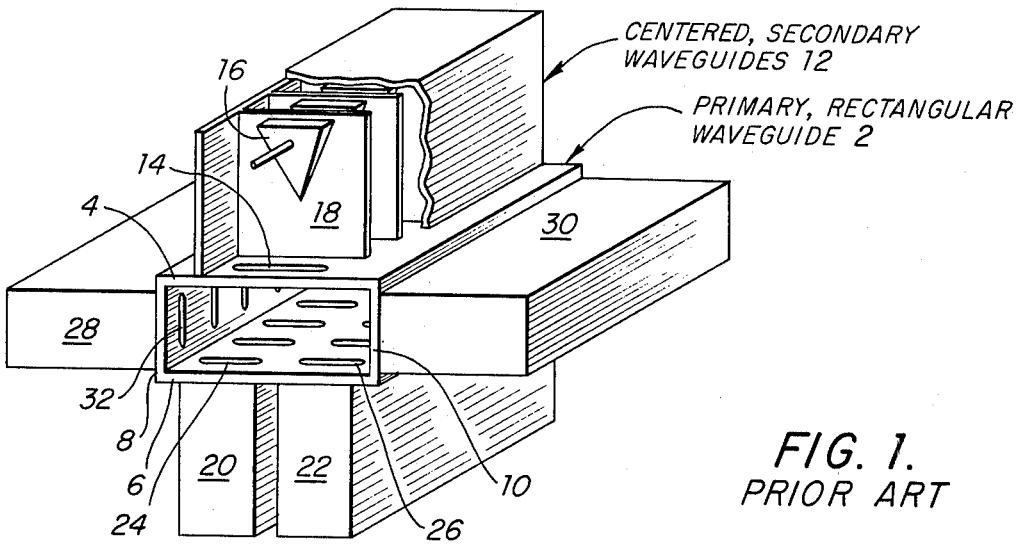
FIG. 1. PRIOR ART
FIG. 1 illustrates schematically a microwave harmonic absorption filter of the prior art having a plurality of secondary waveguides, one of which is partially cut away.

Referring now to the Figures in more detail, a harmonic absorption filter of the prior art is illustrated in FIG. 1. This filter has a primary, rectangular, waveguide 2, formed from elongated wall members 4 and 6 and side wall members 8 and 10. The height and width of primary, rectangular, waveguide 2 are designed to allow microwave energy having frequencies within the pass-band to propagate through the interior of rectangular waveguide 2, in the $TE_{1,0}$ mode only.

Several series of secondary waveguides are attached to the outer surfaces of the walls of rectangular waveguide 2. Such secondary waveguides are used to attenuate microwave energy having a frequency within the stop-band. Thus, secondary waveguides 12 are centered on the outer surface of elongated wall member 4 of primary, rectangular, waveguide 2. Microwave energy within the stop-band and in $TE_{n,0}$ modes, where $n$ is odd, is transmitted by apertures 14 which extend through elongated wall member 4 and into the series of secondary waveguides 12. Therein, microwave energy having frequencies within the stop-band is attenuated by absorbing materials 16 located between positions 18 such as those shown.

Off-center secondary waveguides 20 and 22, located on the outer surface of lower elongated wall member 6, have correspondingly off-centered apertures 24 and 26, respectively. Secondary waveguides 20 and 22 operate in the same manner as waveguide 12 to attenuate microwave energy in the $TE_{n,0}$ modes, when $n$ is even, within the stop-band of frequencies. Finally, secondary waveguides 28 and 30 are located on the outer surfaces of side wall members 8 and 10, respectively. These operate to attentuate stop-band energy in the $TE_{n,0}$ modes, when $n$ is even, in a manner similar to secondary waveguides 12 which, for example, is transmitted through apertures 32.

Figure 2:
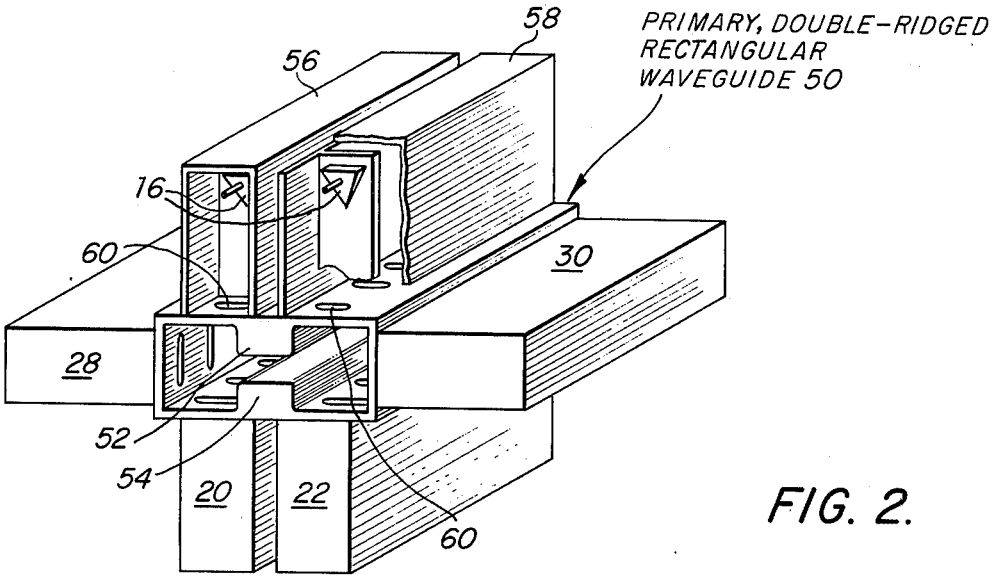
FIG. 2 illustrates graphically a harmonic absorption filter of this invention having a double-ridged, primary, rectangular waveguide.

FIG. 2 illustrates a harmonic absorption filter of this invention. Like numerals refer to like elements in this and subsequent figures. The filter of FIG. 2 is formed from a primary, double-ridged, rectangular waveguide 50, having an upper ridge 52 extending downwardly from the center of the inner surface of the upper elongated wall member, and ridge 54 extending upwardly from the center of the inner surface of lower elongated wall member. Since the apertures cannot be made to intercept the ridges, a series of centered secondary waveguides 12 of FIG. 1 has been replaced in this embodiment with two secondary waveguide series, 56 and 58, which are located off-center. These waveguides are connected to primary, double-ridged, rectangular waveguide 50 by apertures 60. Secondary waveguides 56 and 58 both contain terminations 16 which are designed to attenuate microwave energy within the stop-band frequency range. The use of ridges 52 and 54 in the harmonic absorption filter illustrated in FIG. 2 provides greatly expanded single mode bandwidths which can extend to over two octaves.

Figure 3A:
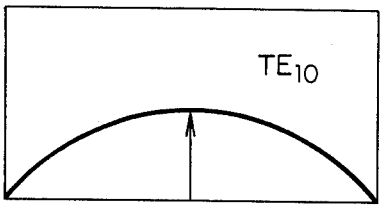
FIGS. 3(a) and 3(b) illustrate graphically profile intensities for electric fields in two different modes.
Figure 3B:
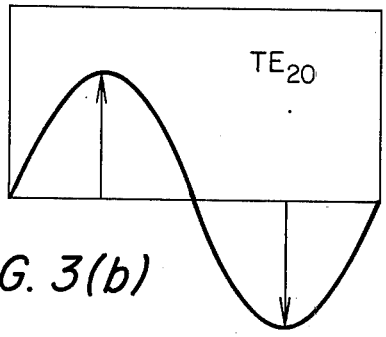

The embodiment illustrated in FIG. 2 tends to attenuate microwave energy in the $TE_{n,0}$ modes, when $n$ is odd, only slightly. When $n$ 1, for example, the profile of the intensity of the y-directed electric field in this mode, $TE_{1,0}$, would appear as illustrated in FIG. 3(*a*). The embodiment of FIG. 2 is better suited to absorb microwave energy in the $TE_{n,0}$ modes, when $n$ is even, because these have an electric field maxima located off the center line. This can be seen in the $TE_{2,0}$ mode which is illustrated in FIG. 3(*b*).

Figure 4:
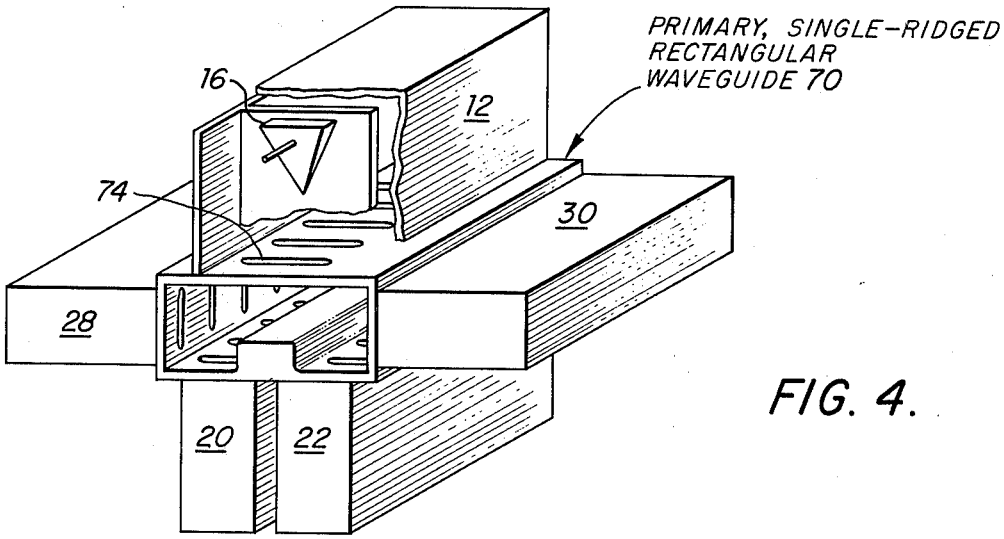
FIG. 4 illustrates schematically a harmonic absorption filter of this invention having a single-ridged, rectangular, waveguide.

A modified embodiment which has good attenuation for both modes is illustrated in FIG. 4. In this embodiment, the harmonic absorption filter has a primary, single-ridged, rectangular, waveguide 70. Second ridge 52, appearing in the embodiment illustrated in FIG. 2, has been eliminated. Additionally, the secondary waveguides on upper wall member 4 have been replaced by a single series of secondary waveguides 12, which is centered. Primary, single-ridged waveguide 70 is connected to secondary waveguides 12 by centered apertures, and microwave energy having frequencies in the stop-band is transmitted therethrough and attenuated within secondary waveguides 12 by terminations 16. This embodiment of the invention offers the advantage of excellent attenuation of microwave energy in the stop-band in both modes where $n$ is even as well as modes where $n$ is odd.

Figure 5:
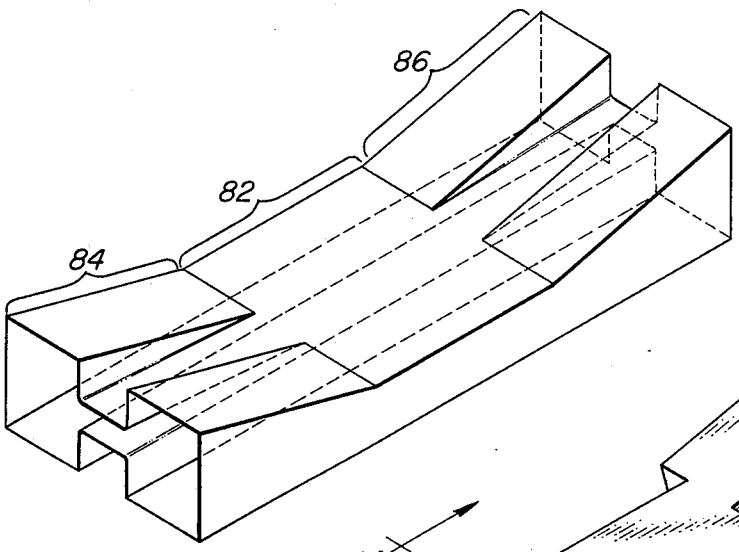
FIG. 5 illustrates schematically the primary guide of a harmonic absorption filter of this invention having a single-ridged, primary, rectangular waveguide with tapered transitions to double-ridged guides on both ends.

The primary guide of a harmonic absorption filter having tapered transitions is illustrated in FIG. 5. This embodiment is particularly useful where the input and output of a single-ridged harmonic absorption filter are constrained to be in the standard double-ridged configuration. As illustrated, this filter has a single-ridged section 82, and smoothly tapered transitions 84 and 86 at both ends. The tapered sections 84 and 86 convert from standard double-ridged configuration to single-ridged configuration. Tapered sections 84 and 86 are made smooth to provide for low reflection of microwave energy despite the change in dimensions of the guide.

Figure 6:
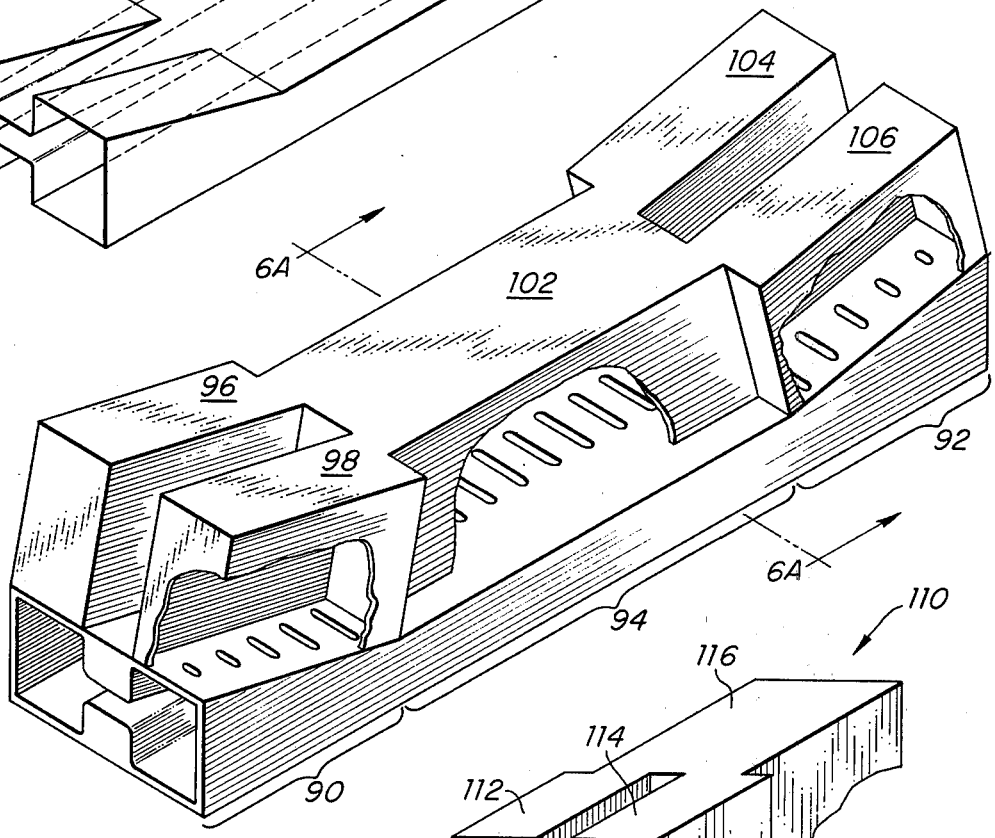
FIG. 6 illustrates schematically a harmonic absorption filter having two tapered transitions from double ridges to a single-ridged rectangular waveguide wherein the transitions includes a series of apertures which gradually increase in size to reduce reflections and the single-ridged waveguide has centered apertures.

FIG. 6 illustrates a particularly preferred embodiment for a harmonic absorption filter according to this invention. In this embodiment, double-ridged, tapered transitions, 90 and 92, join to the respective ends of a single-ridged section 94. As shown, double-ridged tapers 90 and 92 have sets of off-centered apertures with decreasing dimensions tapering down from the center to the ends. Partitions are placed between apertures, but have been omitted in the cut-away portions of the Figure for clarity.

Figure 6A:
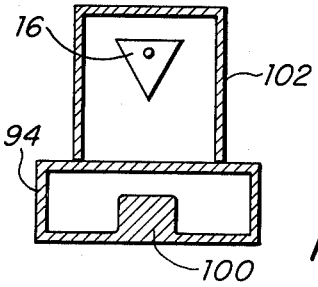
FIG. 6A is a cross-sectional view along the line A—A in FIG. 6.

Microwave energy with frequencies in the stop-band, particularly for those modes where $n$ is even, passes through these apertures to a series of secondary waveguides 96 and 98, which contain terminations or other appropriate lossy material. The tapering size of these apertures helps to eliminate reflections of microwave energy as it is transmitted through the filter. As can be seen in FIG. 6A, which is a cross-sectional view along line A—A, section 94 has a single ridge 100 on its lower wall. Section 94 has a series of uniform apertures which allow energy having a frequency in the stop-band, particularly for modes where $n$ is odd, to pass into the series of secondary waveguides 102 wherein it is attenuated. Waveguides 102 are followed by two series of secondary waveguides 104 and 106 which accept energy in the stop-band through the apertures in double-ridged section 92. Because of the additional apertures and secondary waveguides present with the transitions, the remaining attenuation to be accomplished in the single-ridged section is diminished. Thus, the single-ridged section can be shortened, which helps to compensate for part or all of the additional length required by the addition of the transitions.

Figure 7:
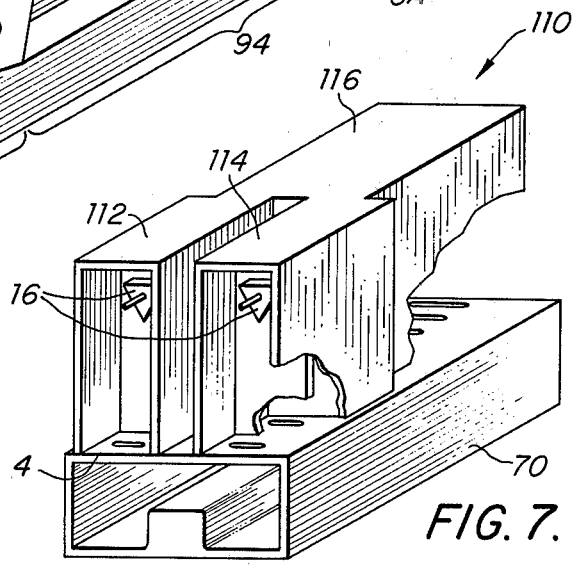
FIG. 7 illustrates schematically another embodiment of this invention utilizing a single-ridged rectangular waveguide having both off-centered and centered secondary waveguides for attenuating microwave energy in the stop-band.

A still further embodiment of the harmonic absorption filters described herein is illustrated in FIG. 7. Therein, the harmonic absorption filter is formed from primary, single-ridged rectangular waveguide 70. Upper wall member 4, however, has a series of seondary waveguides 110 mounted thereon which has an initial portion consisting of off-centered, dual, secondary waveguides 112 and 114. These waveguides are isolated from each other and both contain the standard absorbing materials 16 or terminations. Following waveguides 112 and 114 is another series of waveguides 116 which is centered upon the upper wall member 4 of primary, single-ridge waveguide 70. Dual secondary waveguides 112 and 114 are located off-center and microwave energy in the $TE_{n,0}$ modes, where $n$ is even, are fed into these waveguides through off-centered apertures. The centered portion 116 is suited for attenuating microwave energy with the $TE_{n,0}$ modes, where $n$ is odd. Such microwave frequencies are fed to waveguides 116 through the centered apertures in upper wall member 4 of single-ridged, rectangular waveguide 70.

A wide band harmonic absorption filter, 10 inches in length using single-ridged waveguide of military designation WRS-475-D24, was constructed following the illustration in FIG. 7. The pass-band extended from 4.7 to 9.6 GHz, i.e., over a ratio of 2.04/1. Attenuation was 40, 50 and 60 decibels at 10.9, 11 and 11.1 GHz, respectively. For frequencies higher than 11.1 GHz, the attenuation was even greater than 60 decibels corresponding to a reduction of unwanted signals by a factor $10^{-6}$ for frequencies occurring in the stop-band.

It will be understood that various other changes in the details, materials, and arrangements of parts which have been described and illustrated in order to explain the nature of the invention will occur to and may be made by those skilled in the art upon a reading of this disclosure. Such changes are equivalents and are intended to be included within the principle and scope of this invention which is limited only by the Claims attached hereto.

What is claimed is:

1. A microwave absorption filter, comprising:

a. a primary, rectangular waveguide having first and second elongated wall members and two side wall members and having a ridge substantially centered on the inner surface of a first elongated wall member thereof;

b. secondary waveguides positioned on both sides of said ridge on the outer surface of said first elongated wall member; and, c. apertures extending through said first elongated wall member and connecting the primary, ridged, rectangular waveguide to said secondary waveguides, said apertures being positioned off-center on said first wall member.

2. A microwave harmonic absorption filter of claim 1 wherein said second elongated wall member of said primary, ridged, rectangular waveguide also has apertures connecting said primary, ridged, rectangular waveguide to secondary waveguides positioned off-center on the outer surface of said second elongated wall member.

3. A microwave harmonic absorption filter of claim 1 wherein a second wall member of said primary, ridged, rectangular waveguide has substantially centered apertures connecting said primary, ridged, rectangular waveguide to a single, substantially centered, secondary waveguide positioned on the outer surface of said second elongated wall member.

4. A microwave harmonic absorption filter, comprising:

a. a primary, single-ridged waveguide having first and second elongated wall members and two side wall members;

b. a secondary waveguide containing attenuation means, said secondary waveguide being connected to said primary waveguide by a set of apertures extending through a wall member opposite to that containing said ridge;

c. tapered transitions to double-ridged waveguides at both ends of said primary, single-ridged waveguide.

5. A microwave harmonic absorption filter of claim 4 wherein both of said transitions contain off-centered apertures of varying dimensions, said apertures connecting the transitions to secondary waveguides containing attenuating means.

* * * * *